US008438012B2

(12) United States Patent
Kim et al.

(10) Patent No.: US 8,438,012 B2
(45) Date of Patent: May 7, 2013

(54) METHOD AND APPARATUS FOR ADAPTIVE SUB-BAND ALLOCATION OF SPECTRAL COEFFICIENTS

(75) Inventors: Hyun Woo Kim, Daejeon (KR); Hyun Joo Bae, Daejeon (KR); Byung Sun Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 863 days.

(21) Appl. No.: 12/556,073

(22) Filed: Sep. 9, 2009

(65) Prior Publication Data

US 2010/0161320 A1 Jun. 24, 2010

(30) Foreign Application Priority Data

Dec. 22, 2008 (KR) ..... 10-2008-0131730

(51) Int. Cl.
*G10L 19/02* (2006.01)

(52) U.S. Cl.
USPC ..... 704/203; 704/205; 704/206; 704/219; 704/220

(58) Field of Classification Search ..... 704/203, 704/205, 206, 219, 220
See application file for complete search history.

(56) References Cited

U.S. PATENT DOCUMENTS

| | | | | |
|---|---|---|---|---|
| 5,752,225 | A * | 5/1998 | Fielder | 704/229 |
| 6,324,505 | B1 * | 11/2001 | Choy et al. | 704/230 |
| 6,424,936 | B1 | 7/2002 | Shen et al. | |
| 6,519,558 | B1 * | 2/2003 | Tsutsui | 704/207 |
| 7,050,965 | B2 | 5/2006 | Lopez-Estrada | |
| 2004/0225495 | A1 * | 11/2004 | Makino | 704/229 |

FOREIGN PATENT DOCUMENTS

| | | | |
|---|---|---|---|
| JP | 08-223052 | B2 | 8/1996 |
| JP | 09-230897 | A | 9/1997 |
| KR | 1020070051761 | A | 5/2007 |

OTHER PUBLICATIONS

Stephane Ragot, et al; "ITU-T G.729.1: An 8-32 KBIT/S Scalable Coder Interoperable with G.729 for Wideband Telephony and Voice Over IP" ICASSP 2007, pp. IV-529-IV-532.

* cited by examiner

*Primary Examiner* — Qi Han
(74) *Attorney, Agent, or Firm* — Ladas & Parry LLP

(57) ABSTRACT

An apparatus and method for adaptive sub-band allocation of spectral coefficients are disclosed. The sizes of sub-bands are determined according to the distribution of spectral coefficients transformed from an input speech/audio signal to perform more elaborate quantization in units of sub-bands. Thus, quantization noise of the spectral coefficients is reduced, and sound quality in a frequency region is enhanced, thereby improving the quality of the signal.

14 Claims, 5 Drawing Sheets

METHOD AND APPARATUS FOR ADAPTIVE SUB-BAND ALLOCATION OF SPECTRAL COEFFICIENTS

CROSS-REFERENCE TO RELATED APPLICATION

This application claims the benefit of Korean Application No. 10-2008-0131730, field on Dec. 22, 2008 in the Korean Intellectual Property Office, the disclosure of which is incorporated by reference.

BACKGROUND OF THE INVENTION

1. Field of the Invention

The present invention relates to a method and apparatus for adaptive sub-band allocation of spectral coefficients, and more particularly, to a method and apparatus for adaptive sub-band allocation of spectral coefficients, in which the sizes of sub-bands are determined according to the distribution of spectral coefficients transformed from an input speech/audio signal to perform quantization in units of sub-bands.

2. Description of the Related Art

An analog speech signal is transformed to a PCM (Pulse Code Modulation) signal through sampling and quantization. Such signal transformation requires a large capacity for processing, and is accompanied by many difficulties in storage, transmission, and reproduction due to large capacity.

Therefore, a lot of speech/audio codecs have been developed to compress and restore the PCM signal.

Narrowband codecs for decoding speech having a bandwidth of 300 Hz~3,400 Hz achieve a high compression rate based on LPC (Linear Prediction Coefficient) technique in which a speech generation process is modeled.

In addition, speech/audio codecs of a broad bandwidth (50~7,000 Hz), a superbroad bandwidth (50~1,400 Hz), and a full bandwidth (20~22,000 Hz) use a method of transforming an input signal from a time domain into a frequency domain and quantizing it.

Representative frequency domain transformation methods include DCT (Discrete Cosine Transform), DST (Discrete Sine Transform), DTF (Discrete Fourier Transform), MDCT (Modified Discrete Cosine Transform), and so forth.

MPEG audio codecs employ a method of allocating bits and quantizing spectral coefficients by using a psychoacoustic model, and codecs such as G.729.1 and G.7111.1 employ a method of dividing spectral coefficients into sub-bands having a fixed size and scalar-quantizing the gain of the spectral coefficients in the sub-bands and vector-quantizing the shape thereof.

However, the aforementioned conventional method of allocating spectral coefficients using fixed sub-bands is problematic in that, if the spectrum distribution of sub-bands is high at a specific coefficient, there is a limitation to achieve accurate rendering by vector quantization, thereby causing sound quality degradation.

Moreover, even when the spectrum distribution is uniform on the whole, if a fixed sub-band is used, the distribution of bits is inefficient, and excessive computation compared to signals is carried out. Thus, improvements on these problems are demanded.

SUMMARY OF THE INVENTION

It is an object of the present invention to provide a method and apparatus for adaptive sub-band allocation of spectral coefficients, which can change units in quantization because the sizes of sub-bands are varied according to the distribution of spectral coefficients by determining the sizes of sub-bands corresponding to the distribution of spectral coefficients obtained by signal transformation upon transformation of an input speech or audio signal and performing quantization in units of sub-bands, thereby enabling a more elaborate quantization and accordingly improving the quality of the signal.

To accomplish the above object, there is provided a method for adaptive sub-band allocation of spectral coefficients according to the present invention, comprising the steps of: allocating spectral coefficients transformed from an audio signal to each band; determining whether to permit short sub-bands for the band or not; determining the type of sub-bands for each band corresponding to the distribution of the spectral coefficients upon permission of short sub-bands; and allocating the spectral coefficients for the band to the sub-bands according to the determined type and quantizing the spectral coefficients for each sub-band to output a bit stream.

In the step of determining whether to permit short sub-bands or not, the spectral flatness of the spectral coefficients is measured, if the spectral flatness is smaller than a preset reference value, short sub-bands are permitted, and the reference value is set within the range of 0.3 to 0.6. Further, if short sub-bands are either set as basic sub-bands or selected by input data, short sub-bands are permitted.

In the step of determining the type of sub-bands, the distribution of the spectral coefficients for each band is calculated, and long sub-bands are used in a band in which the amplitude of the spectral coefficients shows a uniform distribution and short sub-bands are used in a band in which the amplitude of the specific coefficients show a non-uniform and wide distribution, and the distribution of the spectral coefficients is calculated by using at least one of the spectral flatness of the spectral coefficients, the ratio of the average value of the spectral coefficients to the maximum value thereof, and a differential value of the maximum value of the spectral coefficients.

Additionally, there is provided an apparatus for adaptive sub-band allocation of spectral coefficients according to the present invention, comprising: a frequency transformation unit for transforming an audio signal into spectral coefficients of a frequency domain; a band setting unit for allocating the spectral coefficients for each band, calculating the spectral flatness and distribution of the spectral coefficients to set the type of sub-bands for each band and allocate the spectral coefficients; and a quantization unit for calculating the gain and shape of the spectral coefficients for each sub-band and quantizing the same.

The band setting unit comprises: a band allocation unit for allocating the spectral coefficients to each band equally or on a log scale; a short sub-band permission determining unit for determining permission or non-permission of short sub-bands for the band; a sub-band type determining unit for determining the type of the sub-bands such that long sub-bands are used in a band in which the spectral coefficients show a uniform distribution and short sub-bands are used in a band in which the spectral coefficients show a non-uniform and wide distribution; and a sub-band allocation unit for allocating the spectral coefficients allocated to the band to the sub-bands according to the type of the sub-bands.

According to the present invention, in the apparatus and method for adaptive sub-band allocation of spectral coefficients, the sizes of sub-bands according to the distribution of spectral coefficients are changed upon speech or audio signal transformation to perform quantization in units of sub-bands. Thus, if a deviation in the amplitude of the coefficients is large, elaborate quantization using short sub-bands is enabled, and if the deviation is small, large sub-bands are set to reduce unnecessary computation. As a result, bits can be efficiently distributed, the efficiency of the system can be enhanced, and signal quality and sound quality can be greatly improved through more elaborate quantization.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE EMBODIMENTS

Hereinafter, an exemplary embodiment of the present invention will be described with reference to the accompanying drawings.

Figure 1:
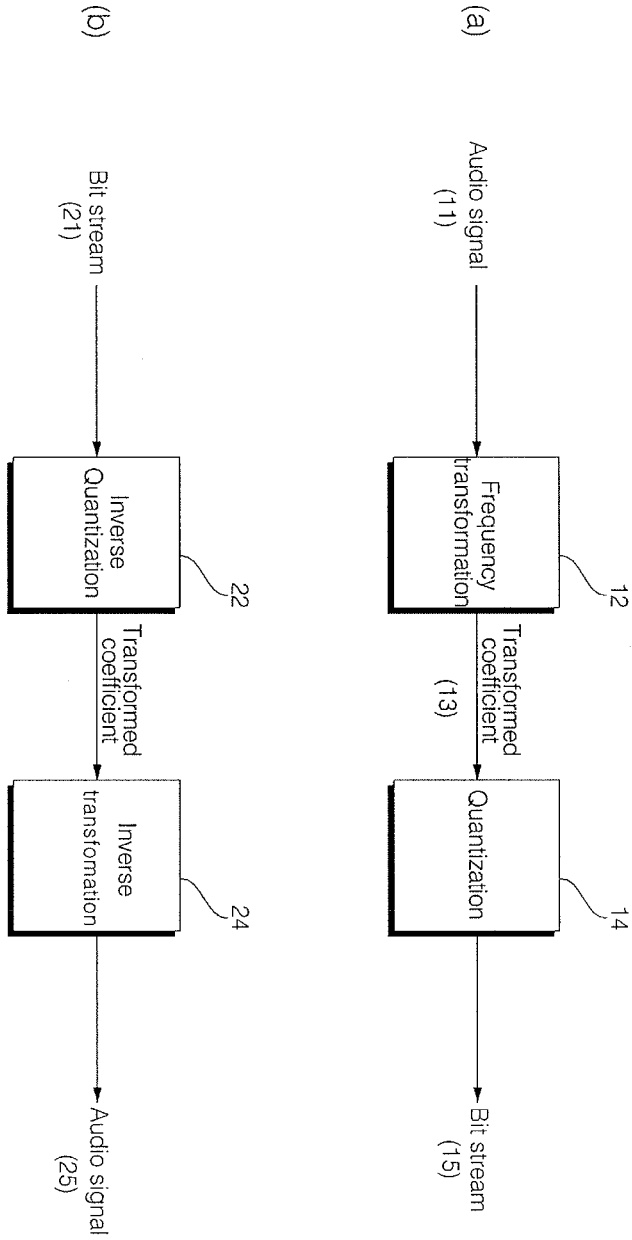
FIG. 1 is a flow chart illustrating a schematic flow depending on changes of an audio signal according to one exemplary embodiment of the present invention.

FIG. 1 is a flow chart illustrating a schematic flow depending on changes of an audio signal according to one exemplary embodiment of the present invention.

In the present invention, as shown in FIG. 1, if an audio signal 11 such as speech is inputted, this audio signal is transformed to generate a bit stream 15 as in (a) of FIG. 1. If the bit stream 21 is inversely transformed into an audio signal 25 as in (b) of FIG. 1, sub-bands are set by using spectral coefficients of the signal, and the spectral coefficients are allocated to the set sub-bands so that quantization can be performed.

In the apparatus for adaptive sub-band allocation of spectral coefficients, an encoder for encoding a speech or audio signal in a frequency domain encodes a speech/audio input signal in a frequency domain, and obtains spectral coefficients through frequency transformation 12. At this point, if quantization 14 of the obtained spectral coefficients is performed, a bit stream 15 is obtained.

Meanwhile, in the apparatus for adaptive sub-band allocation of spectral coefficients, a decoder restores the speech or audio input signal from the bit stream 21, and upon inverse transformation 22, the decoder acquires spectral coefficients from the bit stream 21 and generates an output signal through inverse transformation 24.

The apparatus for adaptive sub-band allocation of spectral coefficients may include, for example, an acoustic input/output apparatus, a cellular phone, a mobile terminal, a computer, and so on. Besides, any apparatuses that transform and output a speech or audio signal or transmit and receive the same may be applicable.

In case of performing quantization 14 using transformed coefficients 13 after frequency transformation 12, the sub-band allocation apparatus sets sub-bands in a frequency domain of a signal to be quantized and allocates spectral coefficients in the band to the sub-bands, so that quantization can be performed in units of sub-bands.

At this time, the adaptive sub-band allocation apparatus varies the sizes of the sub-bands according to the distribution of the spectral coefficients in the frequency band, so that the sub-bands are differently set according to whether the distribution of the spectral coefficients is uniform or the distribution of the spectral coefficients is non-uniform and a difference in their amplitude is large.

If the distribution of spectral coefficients is uniform, degradation of signal quality is small and hence the adaptive sub-band allocation apparatus sets long sub-bands. If the distribution of spectral coefficients is not uniform and a deviation between the values of the coefficients is large, quality degradation is caused by quantization and hence the apparatus sets short sub-bands to perform quantization in units of short sub-bands and output a high-quality bit stream.

At this time, the adaptive sub-band allocation apparatus firstly sets whether or not short sub-bands are permitted. Only when short sub-bands are permitted, short sub-bands are set and the spectral coefficients are allocated to the short sub-bands.

As above, signal transformation using the variation of sub-bands according to the distribution of spectral coefficients may be also applied to the case where a bit stream is inversely transformed into an audio signal.

Figure 2:
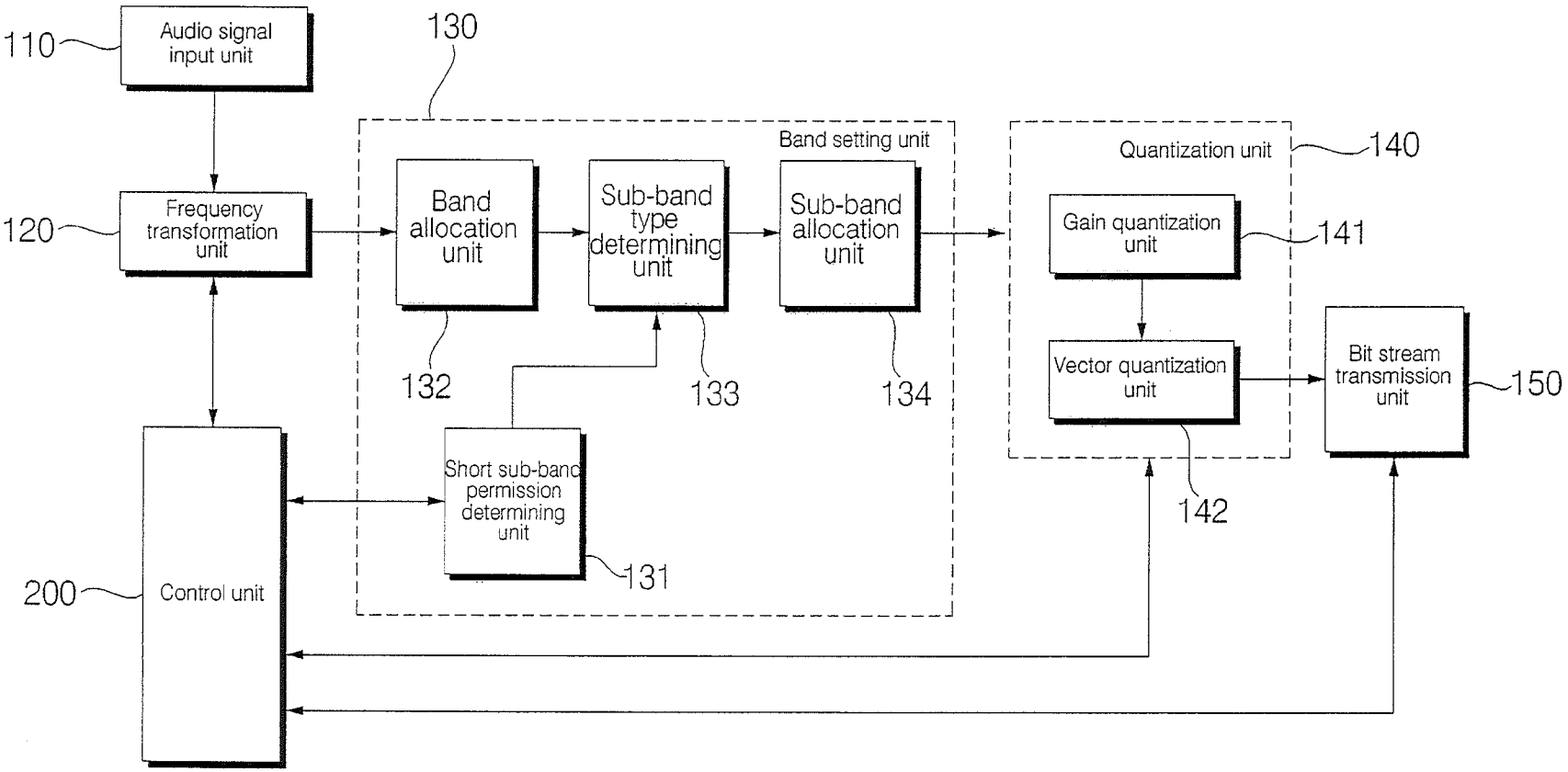
FIG. 2 is a block diagram referred to in explaining a configuration of an apparatus for adaptive sub-band allocation according to one exemplary embodiment of the present invention.

FIG. 2 is a block diagram referred to in explaining a configuration of an apparatus for adaptive sub-band allocation according to one exemplary embodiment of the present invention.

In allocating spectral coefficients to sub-bands, as shown in FIG. 2, the adaptive sub-band allocation apparatus comprises an audio signal input unit 110, a frequency transformation unit 120, a band setting unit 130, a quantization unit 140, a bit stream transmission unit 150, and a control unit 200 for controlling overall operation of the above components.

Although the apparatus of FIG. 2 further comprises a component for transforming an input speech or audio signal into a bit stream to decode the signal and other components, they will not be described so as not to obscure the present invention.

When an analog speech or a certain sound is inputted, the audio signal input unit 110 transforms it into an electrical signal and applies it to the control unit 200. The audio signal input unit 110 may include an audio signal input device such as a microphone or the like, but is not limited thereto and may also include a device for receiving a speech or audio signal from the outside.

The frequency transformation unit 120 transforms an audio signal inputted through the audio signal input unit 110 into a signal of a frequency domain in response to a control command from the control unit 200, and therefore generates spectral coefficients.

The control unit 200 controls input/output of an audio signal, and controls such that a bit stream generated by a decoder is transmitted through the bit stream transmission unit 150. At this time, the control unit 200 applies a control command so that each component performs a predetermined operation in a signal transformation process, and controls flow of data so that a result of each component is applied to a designated component.

When an audio signal is transformed into a signal of a frequency domain by the frequency transformation unit 120, the band setting unit 130 allocates spectral coefficients to bands, and analyzes the distribution of the spectral coefficients an sets sub-bands for each band.

The band setting unit 130 comprises a short sub-band permission determining unit 131, a band allocation unit 132, a sub-band type determining unit 133, and a sub-band allocation unit 134.

The short sub-band permission determining unit 131 determines whether to permit the use of short sub-bands or not based on an input audio signal.

The short sub-band permission determining unit 131 measures the spectral flatness (hereinafter, "flatness") of the spectral coefficients, and permits short sub-bands if the measured flatness is smaller than a reference value and does not permit short sub-bands if the flatness is larger than the reference value.

The short sub-band permission determining unit 131 calculates the spectral flatness (SF) of the spectral coefficients according to the following Equation 1.

$$SF = \frac{\left(\prod_{i=0}^{N-1} |spec(i)|\right)^{\frac{1}{N}}}{\frac{1}{N}\sum_{i=0}^{N-1} |spec(i)|} \quad \text{[Equation 1]}$$

Here, the reference value for flatness may be set within the range of 0.3 to 0.6.

Further, the short sub-band permission determining unit 131 permits short sub-bands if short sub-bands are either set as basic sub-bands or selected by input data.

The band allocation unit 132 allocates the spectral coefficients transformed from the audio signal to each sub-band. At this point, in allocating the spectral coefficients to each band, the band allocation unit 132 may allocate the spectral coefficients equally for each band, or may allocate them on a Bark scale basis by the use of human auditory properties.

For example, in case of equal allocation, if there are 320 MDCT (Modified Discrete Cosine Transform) coefficients and there are 16 bands, the band allocation unit 132 may use the method of allocating 20 MDCT coefficients equally in one band. Also, the number of band may be 1.

The sub-band type determining unit 133 sets whether to use short sub-bands or long sub-bands in each band according to the distribution of the spectral coefficients, so that a determined type of sub-bands is used.

The sub-band type determining unit 133 sets such that long sub-bands are used in a band in which the amplitude of the spectral coefficients shows a uniform distribution and short sub-bands are used in a band in which the amplitude of the specific coefficients shows a wide distribution. In other words, the sub-band type determining unit 133 sets such that, if a uniform distribution is observed due to a small deviation in the amplitude of the spectral coefficients, long sub-bands are used, and if a large deviation is observed due to various amplitudes of the spectral coefficients, short sub-bands are used.

The sub-band type determining unit 133 is able to measure the distribution of spectral coefficients by measuring the spectral flatness of a corresponding band, comparing the maximum and average values of the spectral coefficients, or obtaining a differential value of the maximum value.

In the case that the sub-band type determining unit 133 measures the distribution by comparison of the maximum value and the average value among the aforementioned methods, the distribution is measured as in the following Equation 2

$$\text{Ratio} = \frac{\text{MAX_SPEC}}{\frac{1}{M}\sum_{j=0}^{M-1} |spec(j)|} \quad \text{[Equation 2]}$$

If the ratio of the average value to the maximum value is smaller than a reference value, the sub-band type determining unit 133 determines to use long sub-bands, and if larger than the reference value, the sub-band type determining unit 133 determines to use short sub-bands.

When the size of the sub-bands is determined by the sub-band type determining unit 133, the sub-band allocation unit 134 allocates spectral coefficients of each band to each sub-band.

For example, in a case where 20 coefficients are equally allocated to one band, the sub-band allocation unit 134 may allocate such that one short sub-band consists of five coefficients and there are four short sub-bands.

The quantization unit 140 performs quantization of the signal transformed by the frequency transformation unit 120 depending on the setting of sub-bands by the band setting unit 130 and the allocation of spectral coefficients for the sub-bands to thus generate a bit stream.

The quantization unit 140 includes a gain quantization unit 141 and a vector quantization unit 142. The quantization unit 140 is divided according to a quantization method. If other quantization method is used, a corresponding quantization unit is provided.

The gain quantization unit 141 calculates the gain of the sub-band spectral coefficients, and performs quantization in units of sub-bands by using the calculated gain. At this point, the gain quantization unit 141 performs scalar quantization on a log scale.

The gain of the coefficients can be calculated by the following Equation 3.

$$\text{gain} = 0.5 \times \log\left(\frac{1}{L}\sum_{k=0}^{L-1} |spec(k)|^2 + \varepsilon\right) \quad \text{[Equation 3]}$$

In Equation 3, L denotes the number of spectral coefficients and $\epsilon$ denotes a constant ensuring the value of the log function is non-zero.

The vector quantization unit 142 calculates the shape of the sub-band spectral coefficients, and performs quantization according to the calculated shape. The vector quantization unit 142 normalizes the sub-band spectral coefficients by the gain and calculates the shape, and then performs vector quantization by using a table previously obtained from training data.

When quantization by the quantization unit 140 is completed, the bit stream transmission unit 150 transmits a bit stream outputted from the quantization unit 140 to a predetermined device.

Figure 3:
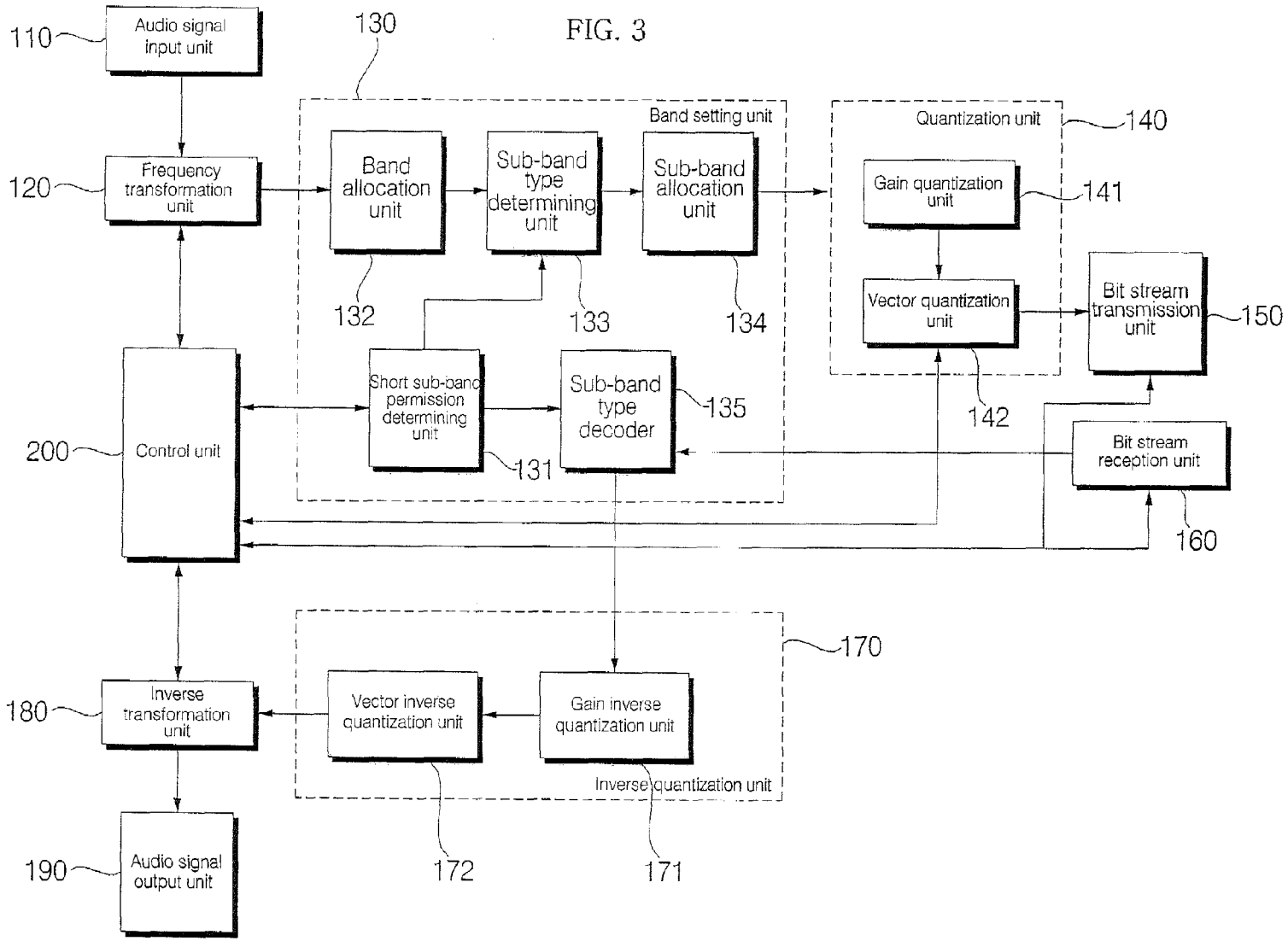
FIG. 3 is a block diagram referred to in explaining another configuration of the apparatus for adaptive sub-band allocation according to one exemplary embodiment of the present invention.

FIG. 3 is a block diagram referred to in explaining another configuration of the apparatus for adaptive sub-band allocation according to one exemplary embodiment of the present invention.

In allocating spectral coefficients to sub-bands, the adaptive sub-band allocation apparatus may be configured as shown in FIG. 3.

Another example of the adaptive sub-band allocation apparatus comprises, as shown in FIG. 2, an audio signal input unit 110, a frequency transformation unit 120, a band setting unit 130, a quantization unit 140, a bit stream transmission unit 150, and a control unit 200 for controlling overall operation of the above components, and may further comprise a component for inversely transforming a bit stream into an audio signal.

It is to be noted that same components as those of the adaptive sub-band allocation apparatus of FIG. 2 described above are referred to by same names and same reference numerals, and detailed description of them is omitted here.

Another example of the adaptive sub-band allocation apparatus comprises a bit stream reception unit 160, an inverse quantization unit 170, and an audio signal output unit 190. The band setting unit 130 further comprises a sub-band type decoder 135.

The bit stream reception unit 160 receives bit stream data from an external or another device.

When permission or non-permission of short sub-bands is determined by the short sub-band permission determining unit 131, the sub-band decoder 135 of the band setting unit 130 therefore applies the size of the sub-bands to sub-band type decoding.

The sub-band type decoder 135 performs sub-band type decoding on a received bit stream and applies the resultant bit stream to the inverse quantization unit 170.

The inverse quantization unit 170, which calculates spectral coefficients from the bit stream and applies them to the inverse transformation unit 180, comprises a gain inverse quantization unit 171 and a vector inverse quantization unit 172.

The gain inverse quantization unit 171 calculates a gain to inversely quantize the bit stream, and the vector inverse quantization unit 172 performs inverse quantization according to shape. The inverse quantization unit 170 may be configured so as to correspond to the quantization method of the quantization unit 140 of the decoder, but a different method may be employed if required.

The inverse transformation unit 180 inversely transforms a signal of a frequency domain to output an audio signal.

The audio signal output unit 170 receives the audio signal transformed in the inverse transformation unit 180 and outputs it to the outside. As the audio signal output unit 170, a speaker or the like may be used.

Upon signal encoding, the adaptive sub-band allocation apparatus sets sub-bands according to the distribution of spectral coefficients and performs quantization for each sub-band. Upon decoding as well, the apparatus may also perform decoding by using the properties corresponding to the distribution of spectral coefficients.

Figure 4:
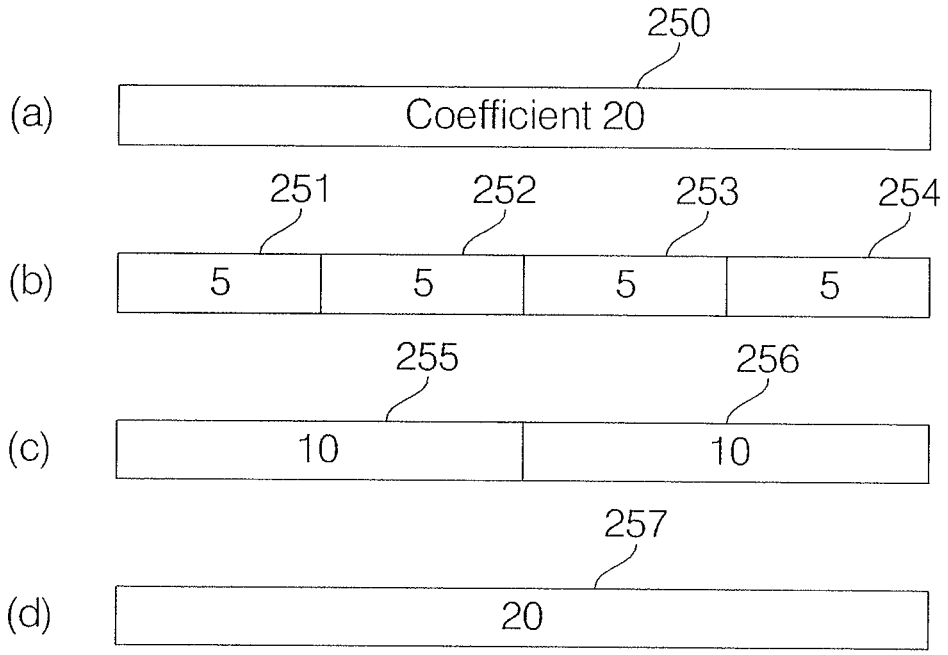
FIG. 4 is a view referred to in explaining the sub-bands corresponding to the distribution of spectral coefficients and the spectral coefficients allocated to the sub-bands according to one exemplary embodiment of the present invention.

FIG. 4 is a view referred to in explaining the sub-bands corresponding to the distribution of spectral coefficients and the spectral coefficients allocated to the sub-bands according to one exemplary embodiment of the present invention.

For example, in a case where 20 coefficients are allocated to one band as shown in (a) of FIG. 4, a plurality of short sub-band are set as shown in (b) of FIG. 4, or a long sub-band is set as shown in (d) of FIG. 4. Alternatively, sub-bands may be set as shown in (c) of FIG. 4. The size of each sub-band may be varied according to the system and the distribution of spectral coefficients.

In a case where 20 coefficients are allocated to one band, if four short sub-bands are used, five coefficients are allocated to each sub-band. If two sub-bands are used, 10 coefficients are allocated to each sub-band.

Figure 5:
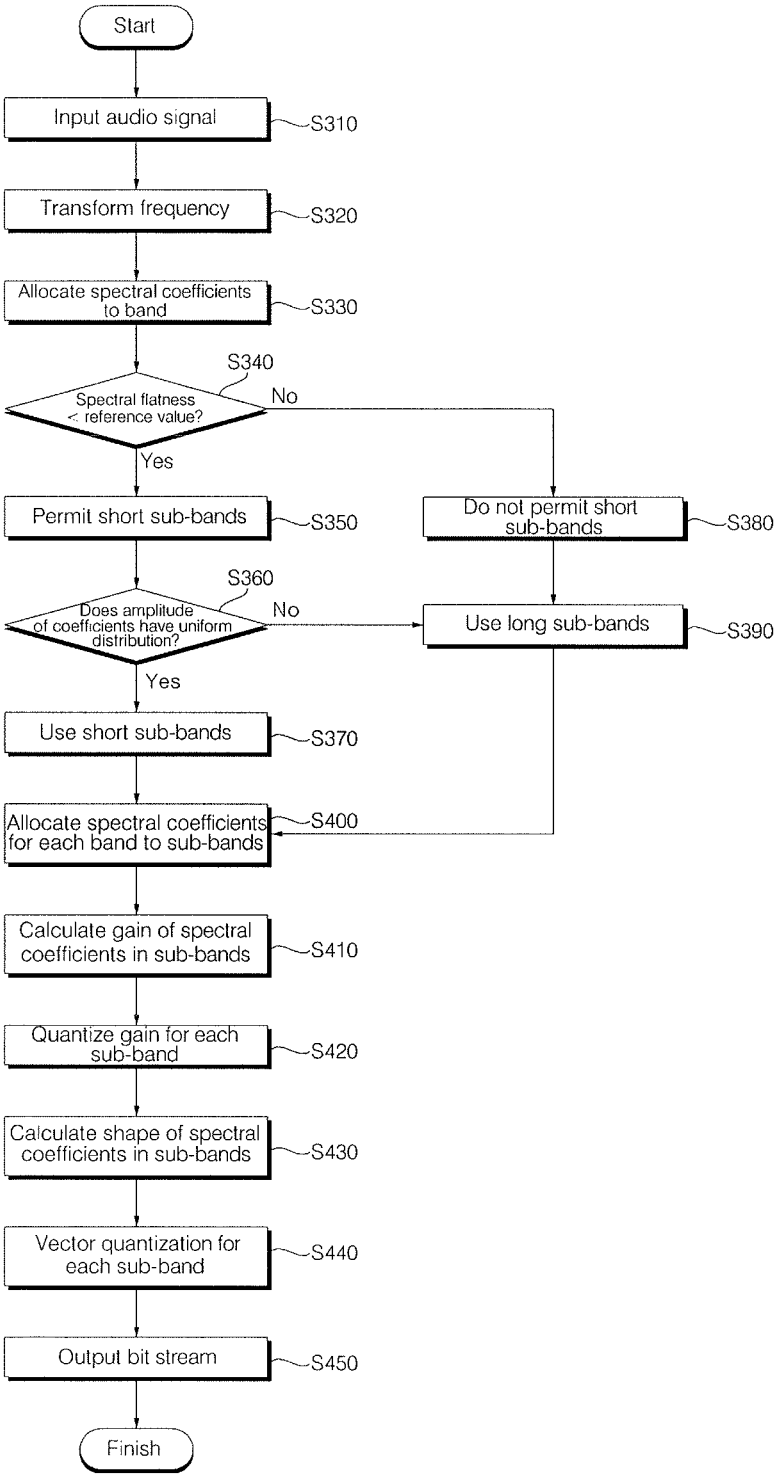
FIG. 5 is a sequence chart referred to in explaining an operation for a method for adaptive sub-band allocation of spectral coefficients upon signal transformation of an audio signal according to one exemplary embodiment of the present invention.

FIG. 5 is a sequence chart referred to in explaining an operation for a method for adaptive sub-band allocation of spectral coefficients upon signal transformation of an audio signal according to one exemplary embodiment of the present invention.

When an audio signal is inputted in S310, the control unit 200 applies the inputted audio signal to the frequency transformation unit 120, and the frequency transformation unit 120 transforms the inputted audio signal into a signal of a frequency domain in S320.

At this time, the band allocation unit 132 allocates spectral coefficients generated by the transformation of the audio signal to each band in S330. In allocating the spectral coefficients to bands, the band allocation unit 132 may allocate the spectral coefficients equally to bands or allocate them on a log scale based on speech characteristics.

The short sub-band permission determining unit 131 measures the distribution of spectral coefficients for each band, and therefore determines permission or non-permission of short sub-bands.

The short sub-band permission determining unit 131 calculates the flatness of the spectral coefficients, and compares the flatness with a reference value in S340. If the flatness is smaller than the reference value, short sub-bands are permitted in S350, and if the flatness is larger than the reference value, the short sub-bands are not permitted in S380. In some cases, if short sub-bands are either set as basic sub-bands or selected by input data, the short sub-bands are permitted.

If the short sub-bands are permitted, the sub-band type determining unit 133 calculates the distribution of the spectral coefficients for each band and sets the size of the sub-bands according to the degree of uniformity of the distribution of the spectral coefficients in S360.

That is, if the amplitude of the coefficients has a uniform distribution, the sub-band type determining unit 133 sets such that short sub-bands are used in S370. Otherwise, if the amplitude of the spectral coefficients has a non-uniform and wide distribution, the sub-band type determining unit 133 sets such that long sub-bands are used in S390.

On the other hand, if the spectral flatness is larger than the reference value, the sub-band type determining unit 133 sets such that short sub-bands are not permitted in S380, and sets such that long sub-bands are used in S390.

Once the size of the sub-bands for each band is determined, the sub-band allocation unit 134 allocates spectral coefficients included for each band to each sub-band in S400.

When the spectrum allocation of sub-bands is completed, the gain quantization unit 141 calculates a gain in units of sub-bands, and performs quantization by using the gain in S420. The vector quantization unit 142 calculates the shape of spectral coefficients for each sub-band in S430, and therefore performs vector quantization in S440.

When quantization is completed, a bit stream is outputted in S450, and the control unit 110 controls such that the bit stream is applied to the bit stream transmission unit 150 and transmitted to a designated destination.

Consequently, the present invention can minimize sound quality degradation caused by a conventional quantization using uniform sub-bands and provide an improved quality by varying the size of the sub-bands according to the distribution of spectral coefficients and performing quantization in units of sub-bands.

Furthermore, the present invention can efficiently distribute bits by using long sub-bands in a band in which the amplitude of the spectral coefficients shows a uniform distribution and short sub-bands are used in a band in which the amplitude of the specific coefficients shows a wide distribution.

As described above, the method and apparatus for adaptive sub-band allocation of spectral coefficients according to the present invention have been described with reference to the illustrated drawings. However, the present invention is not limited to the embodiments and drawings disclosed in the present specification, but may be applied by those skilled in the art without departing from the scope and spirit of the present invention.

What is claimed is:

1. A method for adaptive sub-band allocation of spectral coefficients, comprising the steps of:

allocating spectral coefficients transformed from an audio signal received from an audio signal input device to each band;

determining whether to permit short sub-bands for the band or not through a measured spectral flatness;

determining the type of sub-bands for each band corresponding to a non-uniform distribution of the spectral coefficients upon permission of short sub-bands; and allocating the spectral coefficients for the band to the sub-bands according to the determined type and quantizing the spectral coefficients for each sub-band to output a bit stream.

2. The method of claim 1, wherein, in the step of determining whether to permit short sub-bands or not, the spectral flatness of the spectral coefficients is measured, if the spectral flatness is smaller than a preset reference value, and short sub-bands are either selected by input data or set as basic sub-bands, short sub-bands are permitted.

3. The method of claim 2, wherein, in the step of determining whether to permit short sub-bands or not, if the spectral flatness is smaller than a reference value set within the range of 0.3 to 0.6, short sub-bands are permitted.

4. The method of claim 1, wherein, in the step of determining the type of sub-bands, the distribution of the spectral coefficients for each band is calculated, and long sub-bands are used in a band in which the amplitude of the spectral coefficients shows a uniform distribution and short sub-bands are used in a band in which the amplitude of the spectral coefficients shows a non-uniform and wide distribution.

5. The method of claim 4, wherein, in the step of determining the type of sub-bands, the distribution of the spectral coefficients is calculated by using at least one of the method of calculating the distribution of the spectral coefficients by measuring the spectral flatness of the spectral coefficients, the method of calculating the distribution of the spectral coefficients by comparing the maximum value and average value of the spectral coefficients, and the method of calculating the distribution of the spectral coefficients by calculating a differential value of the maximum value of the spectral coefficients.

6. The method of claim 5, wherein, in the step of determining the type of sub-bands, in the case that the distribution of the spectral coefficients is calculated by using the maximum value and average value of the spectral coefficients, if the ratio of the average value to the maximum value is smaller than a set value, long sub-bands are used, and if the ratio of the average value to the maximum value is larger than the set value, short sub-bands are used.

7. The method of claim 1, wherein, in the step of allocating spectral coefficients to each band, the spectral coefficients are allocated by using at least one of the method of allocating spectral coefficients equally to each band and the method of allocating spectral coefficients to each band on a Bark scale basis by the use of human auditory properties.

8. The method of claim 1, wherein, in the step of outputting a bit stream, the gain of the spectral coefficients of the sub-bands is calculated and scalar-quantized on a log scale, and the shape of the spectral coefficients of the sub-bands is obtained and vector-quantized by using a table previously obtained from training data.

9. An apparatus for adaptive sub-band allocation of spectral coefficients, comprising:

an audio signal input device;

a frequency transformation unit for transforming an audio signal from the audio signal input device into spectral coefficients of a frequency domain;

a band setting unit for allocating the spectral coefficients for each band, calculating the spectral flatness and distribution of the spectral coefficients to set the type of sub-bands for each band and allocate the spectral coefficients; and a quantization unit for calculating the gain and shape of the spectral coefficients for each sub-band and quantizing the same.

10. The apparatus of claim 9, wherein the band setting unit comprises:

a band allocation unit for allocating the spectral coefficients to each band equally or on a log scale;

a short sub-band permission determining unit for determining permission or non-permission of short sub-bands for the band;

a sub-band type determining unit for determining the type of the sub-bands; and a sub-band allocation unit for allocating the spectral coefficients allocated to the band to the sub-bands according to the type of the sub-bands.

11. The apparatus of claim 10, wherein, if the spectral flatness of the spectral coefficients is smaller than a preset reference value, and short sub-bands are either selected by input data or set as basic sub-bands, the short sub-band permission determining unit permits short sub-bands.

12. The apparatus of claim 10, wherein the sub-band type determining unit sets so as to correspond to the distribution of the spectral coefficients such that long sub-bands are used in a band in which the spectral coefficients show a uniform distribution and short sub-bands are used in a band in which the spectral coefficients show a non-uniform and wide distribution.

13. The apparatus of claim 12, wherein the sub-band type determining unit calculates the distribution of the spectral coefficients by using at least one of the spectral flatness of the spectral coefficients allocated for each band, the comparison of the average value of the spectral coefficients and the maximum value thereof, and a differential value of the maximum value of the spectral coefficients.

14. The apparatus of claim 13, wherein, in the case that the distribution of the spectral coefficients is calculated by using the maximum value and average value of the spectral coefficients, the sub-band type determining unit determined such that, if the ratio of the average value to the maximum value is smaller than a set value, long sub-bands are used, and if the ratio of the average value to the maximum value is larger than the set value, short sub-bands are used.

* * * * *